US005207249A

United States Patent [19]

Healy

[11] Patent Number: 5,207,249

[45] Date of Patent: May 4, 1993

[54] VAPOR RECOVERY SYSTEM AND PUMP

[75] Inventor: James W. Healy, Hollis, N.H.

[73] Assignee: Healy Systems, Inc., Hudson, N.H.

[21] Appl. No.: 741,328

[22] Filed: Aug. 7, 1991

[51] Int. Cl.[5] ..... B67D 5/06

[52] U.S. Cl. ..... 141/59; 141/46; 141/290; 417/179

[58] Field of Search ..... 141/42, 46, 59, 206, 141/285, 290, 301-303; 417/179, 79, 182, 182.5; 73/40.5 R, 49.1, 49.2 R

[56] References Cited

U.S. PATENT DOCUMENTS

| | | | |
|---|---|---|---|
| 3,183,723 | 5/1965 | Deters | 73/40.5 R |
| 3,952,781 | 4/1976 | Hiller et al. | 141/46 |
| 4,149,828 | 4/1979 | Affri | 417/179 X |
| 4,256,151 | 3/1981 | Gunn | 141/59 |
| 4,310,033 | 1/1982 | Deters | 141/59 X |
| 4,336,830 | 6/1982 | Healy | 141/59 |
| 5,088,528 | 2/1992 | Grantham | 141/59 X |
| 5,090,234 | 2/1992 | Maresca, Jr. et al. | 73/49.1 |

*Primary Examiner*—Henry J. Recla
*Assistant Examiner*—Casey Jacyna
*Attorney, Agent, or Firm*—Hayes, Soloway, Hennessey & Hage

[57] ABSTRACT

A liquid jet gas pump is connected to a vapor return line for a plurality of liquid dispensing nozzles. The jet pump has a multi-jet orifice plate and a single diffuser tube is coaxially aligned with the orifices in the plate, all of the jets entering the single diffuser tube.

13 Claims, 3 Drawing Sheets

VAPOR RECOVERY SYSTEM AND PUMP

The present invention is directed to liquid jet gas pumps for connection to a vapor return line in a gasoline service station to recover gasoline vapors during motor vehicle refueling operations.

BACKGROUND OF THE INVENTION

As described in my earlier U.S. Pat. Nos. 4,095,626 and 4,336,830, the pressure in the gasoline being pumped is used to operate a liquid jet gas pump having its liquid inlet in communication with the pressurized gasoline being delivered to individual pumps.

New regulations currently being adopted in California, and in other phase two vapor recovery areas, require a secondary containment of any underground piping containing gasoline even if at atmospheric pressure. While the Healy model 8500 series multi-jet pump has been developed to provide a central vacuum pump for handling a number of vapor recovery nozzles in simultaneous operation, it is basically a multiplication of the type of jet pump shown in the above mentioned patents wherein a plurality of vapor jets exit into a plurality of mixing or diffuser tubes for entraining the vapors.

SUMMARY OF THE INVENTION

The present invention involves a high capacity liquid jet gas pump adapted to be connected to a plurality of liquid dispensing stations. It is arranged to be close coupled to the liquid supply pump in the storage tank. It is equipped with a multi-jet orifice plate which discharges a plurality of jets into a single diffuser tube which is coaxially aligned with the orifices in the plate. The small physical size of the device permits it to be installed within an existing service station pump pit without recourse to cutting out and reconstructing the concrete pad covering the tank storage area. This permits the gasoline discharge from the pump to return directly to the underground tank from which it was supplied, thus leaving the underground vapor return piping dry. This permits reduction of the complexity of the piping system since a single piping network can be used to return gasoline vapor from any nozzle without regard to the product being dispensed. The large pumping capacity and high vacuum levels achieved by the present invention also permit enhanced vapor recovery efficiency for the system. The increase in pumping capacity resulting from the novel multi-jet construction operates to provide a more uniform vacuum pressure differential at the nozzle and better pressure regulation in the nozzle boot vehicle fill pipe. In addition, the higher vacuum level capability of −75 inches of water column (wc) provides a reliable, fully automatic, method of clearing the vapor tube within the coaxial hose assembly. The hose attachment to a multi-jet product dispenser in a normal gasoline station is approximately 90 inches above the driveway surface. A 90 inch column of gasoline is equivalent to approximately 66 inches of water, therefore the −75 inch water column of vacuum is more than adequate to lift any gasoline in the vapor recovery line and clear the hose.

DETAILED DESCRIPTION OF THE INVENTION

In order to more fully understand the present invention, reference should be had to the following detailed description taken in connection with the following drawings wherein.

Figure 1:
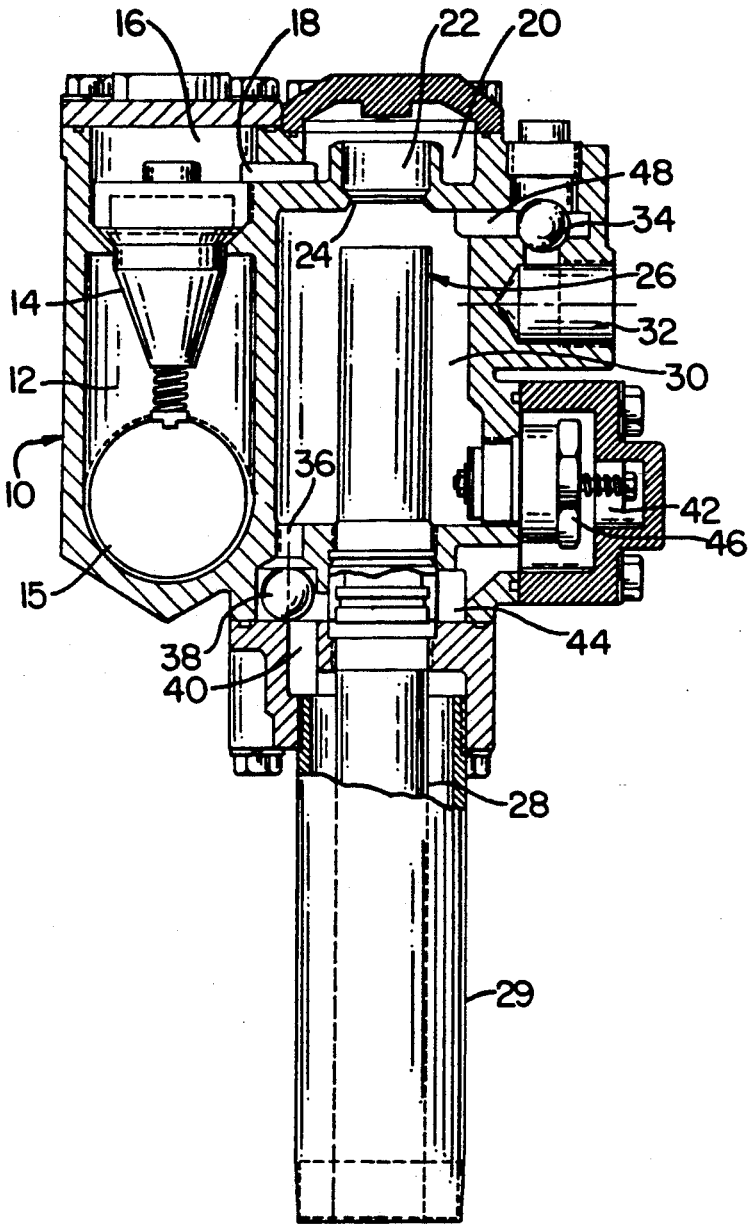
FIG. 1 is a diagramatic sectional view of one preferred embodiment of the invention.
Figure 2:
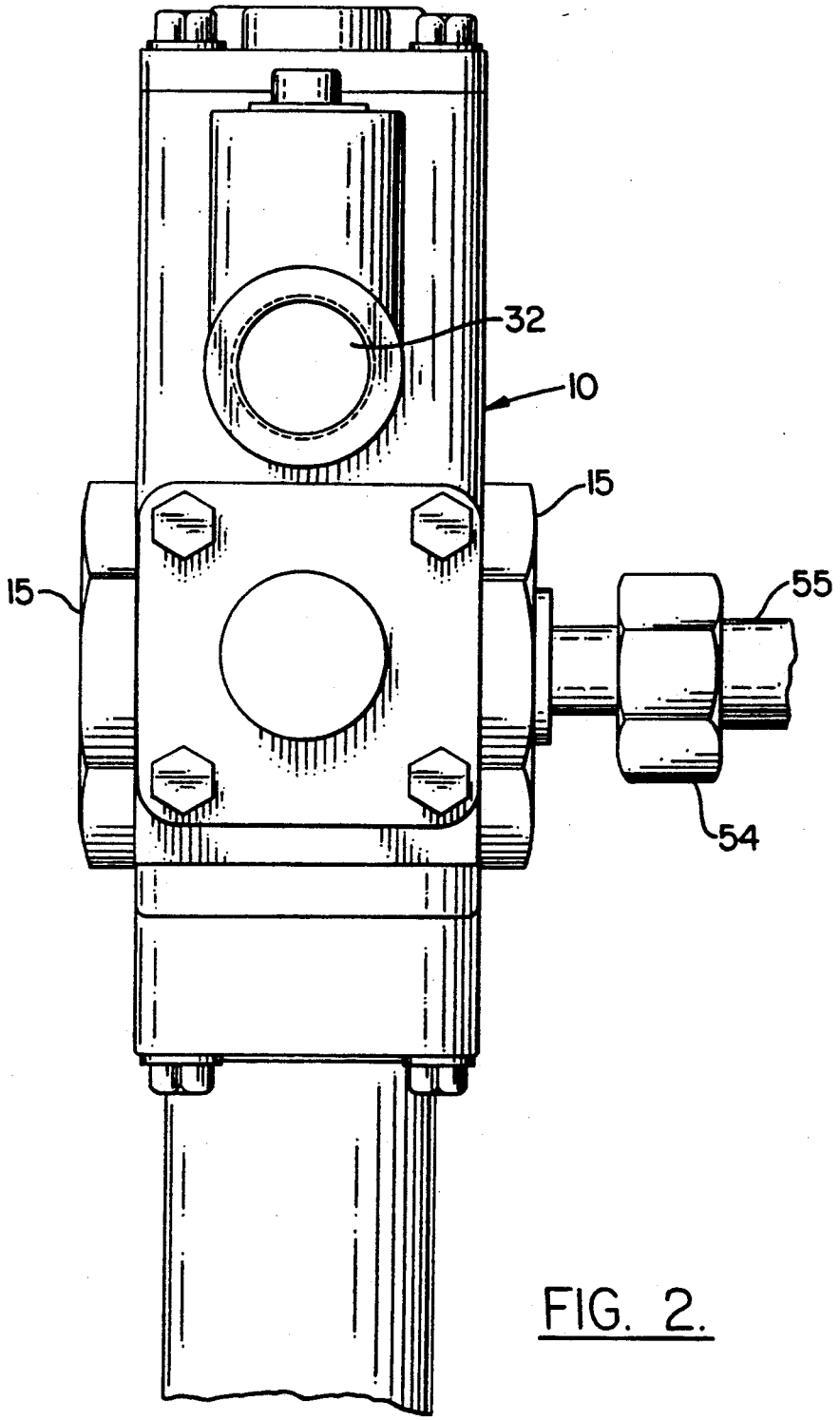
FIG. 2 is a side view of the device of FIG. 1 taken at 90° to the plane of FIG. 1.

Referring now to FIGS. 1 and 2 there is shown a partially sectional, diagramatic schematic view of a preferred form of the invention wherein the pump comprises housing 10 having a fluid supply chamber 12 which is preferably directly coupled into the main gasoline supply pipe 15 from the discharge of the gasoline pump. This would typically be a 2 inch pipe opening. (see FIG. 2) Gasoline from the main supply enters the chamber 12 in the process of flowing through the pump. When this is pressurized to 25 to 30 psi the pressure passes upwardly through a check valve and restrainer 14 and into a second chamber 16 at the top of the jet pump. The gasoline, at full pressure, then passes through the passage 18 into a third chamber 20 at the top of the jet pump. This fills a fourth chamber 22 above a jet orifice plate 24 with gasoline at full pressure. The gasoline then jets downwardly into a mixing or diffuser tube 26 and its extension 28 entraining gasoline vapor in tube 26 and creating a vacuum in the space 30 surrounding the diffuser tube 26. The space 30 is connected to an inlet opening 32 connected to vapor return line 33 (see FIG. 4). The flow of vapor through inlet 32 lifts the check valve 34 whenever the jet pump is in operation. The vapor pumped by the jets entering the tube 26 is returned to the gasoline storage tank below the pump through pipe 29.

The space 30 surrounding the diffuser tube 26 has several openings at the bottom. There is one opening 36 which is closed by a ball valve 38 which is pulled into its upper position when the jet pump is operating. Whenever vacuum is not present, this ball valve 38, drops to its lower position and permits direct access between the chamber 30 and the vapor space 40 which communicates with the vapor space above the underground tank. This vapor space 40, also has access to a chamber 42 through a passage 44 which communicates through a vacuum relief valve 46 into the space 30. The vacuum relief valve 46 is set to control the maximum vacuum in the chamber 30 at a preset vacuum (e.g. −75 inches of water column). Thus, if only one or two pumps are in operation, it will constantly bleed some vapor into the space 30 to prevent the vacuum from exceeding −75 inches water column or whatever other vapor pressure it is set to control. The third opening into the chamber 30 is through the passage 48 which is closed by the check valve 34 which serves as the main vapor return valve. When the pump turns off, the valve 34 closes the vapor return opening 32 so that gasoline vapor at atmospheric pressure in the tank is not allowed to return to the evacuated vapor return line 33, thus preventing unrestricted reverse flow of air into the tank vent lines. Whenever the jet is turned off the valve 38 opens and any gasoline in the annular space 30 is drained back into the storage tank.

In a preferred form of the invention, gasoline is supplied to chamber 22 at a pressure of 26–30 psi. With an orifice plate 24 having sharp edged orifice holes of 0.1495 inch diameter this gives a jet velocity of about 82 ft/sec. This flow from the 6 jets is more than adequate to create a vacuum of −75 inches water column or above at the entrance to diffuser tube 26.

Figure 3:
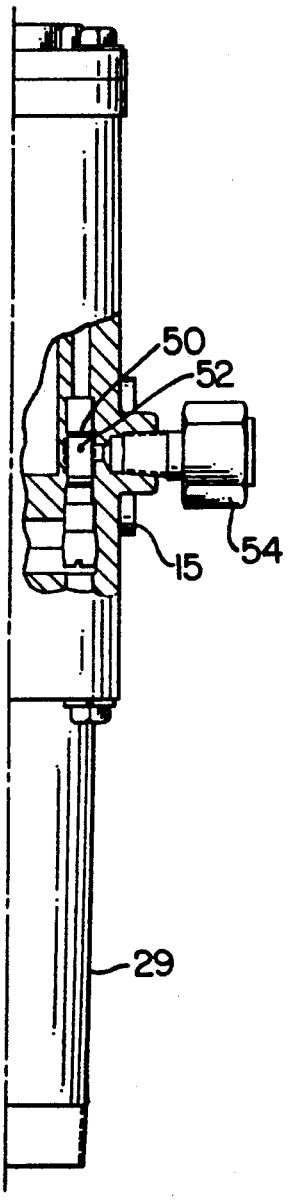
FIG. 3 is a section like FIG. 2 showing the inclusion of an additional jet pump for pumping condensate from the condensate sump in the vapor return line.

Referring now to FIG. 3, there is shown an additional feature of the invention wherein an auxiliary jet 50 is provided in the side of the housing in communication with the space 22 at the top of the jet pump which contains gasoline at full line pressure. This jet 50 has a single orifice which jets into a diffuser tube 52 and is coupled to the condensate return line 55 (see FIG. 4) by means of coupling 54. This jet creates sufficient vacuum to remove condensed gasoline in condensate return line 55 from the low point 56 of the vapor return line. Thus, it is not necessary to provide any additional pump for this vapor condensate return. As mentioned earlier, if there are large quantities of condensate in the vapor line due to erroneous filling of the nozzle they can be cleared by the operation of the main multi-orifice jet which has 75 inches of water column vacuum. This degree of vacuum is more than adequate to remove any gasoline inadvertently provided in the vapor piping associated with the hose in the case of overfilling of an automobile gasoline tank.

Figure 4:
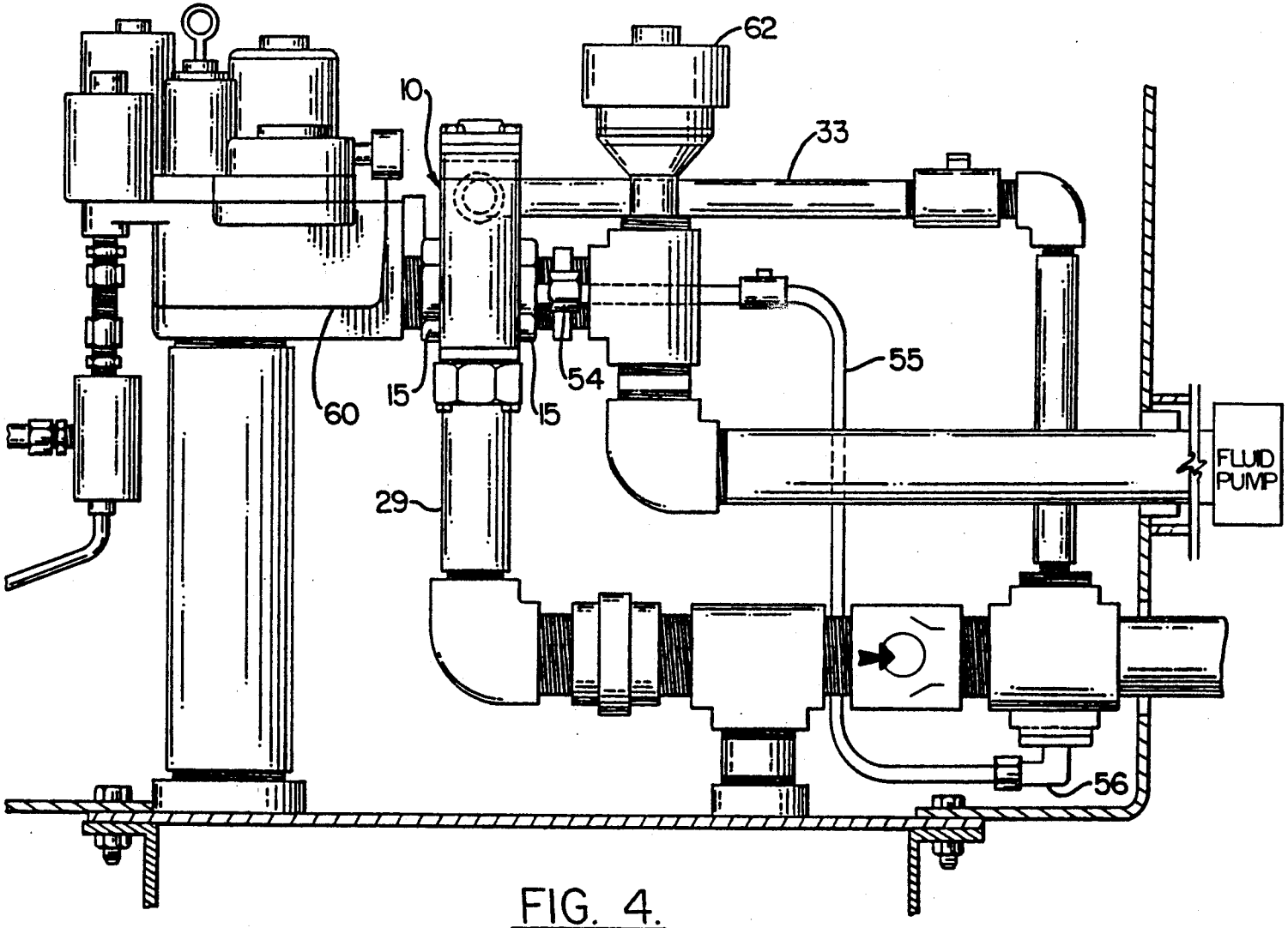
FIG. 4 shows a preferred installation of the jet pump of the present invention direct coupled to the output of the main gasoline pump and between the pump and the leak detector for checking leaks in the total system.

Referring to FIG. 4, a preferred installation of the system is shown wherein the jet pump of the present invention (shown at 10) is directly coupled to the output 15 of a gasoline pump 60 which feeds pressurized gasoline into a plurality of separate nozzles. This close coupling provides high pressure gasoline directly to the jet pump but does not interfere with the flow of gasoline to the various delivery nozzles. On the output of the main gasoline line 15 which passes through the jet pump housing 10, there is positioned the usual leak detector 62 which checks for leaks in all of the gasoline pumping pipes leading to the various delivery nozzles prior to delivery of any gasoline. If no leaks are detected, then gasoline can be delivered from any nozzle connected to the high pressure gasoline piping. If a leak is detected, the gasoline pump is turned off. It will not be restarted until the source of the leak has been located and fixed.

The installation of the jet pump 10 between the main gasoline pump 60 and the leak detector 62 permits the leak detector to check all of the piping between it and the various nozzles. However, it does not check for any leak in the jet pump. If the jet pump is not installed before the leak detector, it must have an additional solenoid valve to control release of gasoline to the chamber 20 above the jet orifice plate 24. This involves an additional complication in wiring and construction and requires a time delay circuit. However, the present invention provides a simple housing having a high capacity passage running through it for main gasoline flow and simple mechanical valves for controlling the operation in a fail safe fashion. It needs no electrical connections and no time delay circuits for its operation when it is installed as shown in FIG. 4.

I claim:

1. In a high capacity liquid jet gas pump having a housing and means for connecting the pump housing (a) directly in a liquid supply line, (b) to a vapor return line adapted to be connected to at least one liquid dispensing station and (c) to a liquid supply chamber, said jet pump creating a vacuum to draw vapor from the dispensing stations through the return line; the improvement wherein the jet pump has a multi-jet orifice plate and a diffuser tube is positioned in the housing and is coaxially aligned with the orifices in the plate for receiving a multiplicity of jets from the orifice plate, a passage through which liquid is pumped from said liquid supply chamber to said liquid dispensing stations, a vapor chamber that surrounds the diffuser tube and valve means for controlling the vacuum created by the jet pump by connecting the vapor chamber to the liquid supply chamber.

2. The pump of claim 1 wherein the orifice plate will provide a jet velocity for each jet of at least 60 ft/sec with a liquid pressure of at least 30 psi.

3. The pump of claim 1 where the orifice plate has at least 5 jets.

4. The pump of claim 1 wherein a separate jet pump is provided in the jet pump housing, said separate jet pump being supplied from a main gasoline pump and a vapor line to said separate jet pump being connected to a low point in the vapor return line to remove condensate therefrom.

5. In a vapor recovery system for use with systems for dispensing volatile liquids, such as liquid fuels, from a reservoir wherein the liquid is pumped under pressure through a hose and discharged through a vapor recovery dispensing nozzle into the inlet of a container such as a fuel tank, the vapor recovery system comprising:

a liquid jet gas pump having its liquid inlet in communication with the pressurized liquid so as to receive a portion thereof, and a vapor conduit having one end in said nozzle and adapted to be placed in communication with the interior of said container when said nozzle is inserted into said inlet and the other end in communication with the vapor inlet of said jet pump, the outlet of said jet pump discharging into said reservoir, whereby vapor displaced from said container as it is filled will be drawn off through said conduit by suction created by the passage of said liquid through said jet pump, the improvement wherein the jet pump has a multi-jet orifice plate and a diffuser tube coaxially aligned with the orifices in the plate, all of the jets leaving the orifice plate entering the diffuser tube, a vapor chamber that surrounds the diffuser tube and valve means for controlling the vacuum created by the multi-jet pump by connecting the vapor chamber to the resevoir.

6. In a vapor recovery system adapted for use with systems for dispensing volatile liquids having a liquid pump supplying at least one nozzle, a vapor recovery line for each nozzle, a fluid pump for delivering liquid to each nozzle, a jet pump for pumping vapor generated at the at least one nozzle, the jet pump having sufficient capacity to handle all the vapor generated by at least a majority of said at least one nozzle, and a leak detector in the liquid supply line for checking leaks between the liquid pump and each nozzle, the improvement wherein the jet pump has a housing which is directly coupled in the liquid line between the outlet of the liquid pump and the input to the leak detector, and said housing contains a multi-jet orifice plate which discharges high pressure liquid jets in to a single diffuser tube within the housing said housing further contains a vapor chamber that surrounds the diffuser tube and valve means for controlling the vacuum created by the jet pump by connecting the vapor chamber to the outlet of the diffuser tube.

7. The system of claim 7, wherein said jet pump has an auxiliary jet pump which is connected to a low point in said vapor recovery line for removing condensate from said low point.

8. In a high capacity liquid jet gas pump having means for connecting the pump to a vapor return line adapted to be connected to at least one liquid dispensing station and a liquid supply chamber; the improvement wherein the jet pump has a multi-jet orifice plate and a diffuser tube is coaxially aligned with the orifices in the plate for receiving a multiplicity of jets from the orifice plate and further comprising a vapor chamber that surrounds the diffuser tube and three passages are provided between the vapor chamber and the return line to a liquid storage tank, the first passage being the diffuser tube, the second passage being a pressure relieve valve for bleeding back pressure to the vapor chamber when the vacuum is greater than a preset amount, the third passage being a liquid drain passage at the bottom of the vapor chamber, the third passage being closed by a valve which moves to a closed position when the jet creates a vacuum in the diffuser tube.

9. The pump of claim 8 wherein the orifice plate will provide a jet velocity for each jet of at least 60 ft/sec with a liquid pressure of at least 30 psi.

10. The pump of claim 8 wherein the orifice plate has at least 5 jets.

11. The pump of claim 8 wherein a separate jet pump is provided in a housing for the multi-jet pump, said separate jet pump being supplied from a main gasoline pump and a vapor line to said separate jet pump being connected to a low point in the vapor return line to remove condensate therefrom.

12. In a vapor recovery system for use with systems for dispensing volatile liquids, such as liquid fuels, from a reservoir wherein the liquid is pumped under pressure through a hose and discharged through a vapor recovery dispensing nozzle into the inlet of a container such as a fuel tank, the vapor recovery system comprising:

a liquid jet gas pump having its liquid inlet in communication with the pressurized liquid so as to receive a portion thereof, and a vapor conduit having one end in said nozzle and adapted to be placed in communication with the interior of said container when said nozzle is inserted into said inlet and the other end in communication with the vapor inlet of said jet pump, the outlet of said jet pump discharging into said reservoir, whereby vapor displaced from said container as it is filled will be drawn off through said conduit by suction created by the passage of said liquid through said jet pump, the improvement wherein the jet pump has a multi-jet orifice plate and a diffuser tube coaxially aligned with the orifices in the plate, all of the jets leaving the orifice plate entering the diffuser tube and further comprising a vapor chamber that surrounds the diffuser tube and three passages provided between the vapor chamber and the return line to a liquid storage tank, the first passage being the diffuser tube, the second passage being a pressure relief valve for bleeding back pressure to the vapor chamber when the vacuum is greater than a preset amount, the third passage being a liquid drain passage at the bottom of the vapor chamber, the third passage being closed by a valve which moves to a closed position when the jet creates a vacuum in the diffuser tube.

13. The pump of claim 12 wherein a separate jet pump is provided in a housing for the jet pump, said separate jet pump being supplied from a main gasoline pump and a vapor line to said separate jet pump being connected to a low point in the vapor return line to remove condensate therefrom.

* * * * *

UNITED STATES PATENT AND TRADEMARK OFFICE

CERTIFICATE OF CORRECTION

PATENT NO. : 5,207,249

DATED : May 4, 1993

INVENTOR(S) : James W. Healy

It is certified that error appears in the above-identified patent and that said Letters Patent is hereby corrected as shown below:

Claim 7, Col. 5, Line 3, delete "7" and insert --6--.

Signed and Sealed this

Eighth Day of March, 1994

Bruce Lehman

*Attest:*

BRUCE LEHMAN

*Attesting Officer*

*Commissioner of Patents and Trademarks*